US006636205B1

(12) United States Patent
Lasneski

(10) Patent No.: US 6,636,205 B1
(45) Date of Patent: Oct. 21, 2003

(54) METHOD AND APPARATUS FOR DETERMINING A CLOCK TRACKING FREQUENCY IN A SINGLE VERTICAL SYNC PERIOD

(75) Inventor: Alan L. Lasneski, Turner, OR (US)

(73) Assignee: InFocus Corporation, Wilsonville, OR (US)

( * ) Notice: Subject to any disclaimer, the term of this patent is extended or adjusted under 35 U.S.C. 154(b) by 0 days.

(21) Appl. No.: 09/545,989

(22) Filed: Apr. 10, 2000

(51) Int. Cl.[7] ..... G09G 5/00
(52) U.S. Cl. ..... 345/204; 345/213
(58) Field of Search ..... 345/204, 205, 345/206, 208, 98, 99, 100, 212, 213

(56) References Cited

U.S. PATENT DOCUMENTS

| | | | | | |
|---|---|---|---|---|---|
| 4,905,085 | A | | 2/1990 | Faulhaber | 358/148 |
| 5,404,173 | A | | 4/1995 | Parrish et al. | 348/537 |
| 5,539,473 | A | | 7/1996 | Kommrusch et al. | 348/537 |
| 5,585,841 | A | * | 12/1996 | Hardin | 348/163 |
| 5,657,089 | A | | 8/1997 | Onagawa | 348/537 |
| 5,724,036 | A | * | 3/1998 | Kobayashi et al. | 345/98 |
| 5,764,216 | A | * | 6/1998 | Tanaka et al. | 345/147 |
| 5,767,916 | A | | 6/1998 | West | 348/537 |
| 5,805,233 | A | | 9/1998 | West | 348/537 |
| 5,917,461 | A | * | 6/1999 | Sakami et al. | 345/29 |

* cited by examiner

*Primary Examiner*—Steven Saras
*Assistant Examiner*—Alecia D. Nelson
(74) *Attorney, Agent, or Firm*—Schwabe, Williamson & Wyatt, PC

(57) ABSTRACT

A line parameter detection circuit (70) of this invention includes an active video detector (72) that generates an "active video" signal (102) indicative of a video signal (100) containing video data that exceeds a predetermined threshold level. The line parameter detection circuit further includes three counters (82, 84, 86) that are incremented by a reference clock (110). The counters are reset and start counting reference clock pulses upon receiving an $H_{SYNC}$ pulse (104). A left edge register (90) stores the count accumulated in the first counter upon receiving a rising edge of the active video signal, a right edge register (92) stores the count accumulated in the second counter upon receiving a falling edge of the active video signal, and a line length register (96) stores the count accumulated in the third counter upon receiving the next subsequent $H_{SYNC}$ pulse. Each video signal scan line includes blanking periods (106, 108) between the $H_{SYNC}$ pulses and the active video region. The precise locations and timings of the blanking periods are typically unknown, however the period of the active video region is known because it coincides with the active video signal period. The timing ratio of the active video region to the blanking periods is determined from the line parameter detection circuit, from which the ratio of total blanking time to total line time is determined. The ratio of total blanking time to total line time is used to calculate the overall tracking period, and from that a tracking number n and pixel clock pulse frequency can be calculated.

17 Claims, 4 Drawing Sheets

METHOD AND APPARATUS FOR DETERMINING A CLOCK TRACKING FREQUENCY IN A SINGLE VERTICAL SYNC PERIOD

RELATED APPLICATION(S)

Not Applicable

FEDERALLY SPONSORED RESEARCH OR DEVELOPMENT

Not Applicable

1. Technical Field

This invention relates to analog-to-digital conversion, and more particularly to automatically determining an optimal sampling clock frequency for performing analog-to-digital conversion of a video signal.

2. Background of the Invention

Presentations using multimedia projection display systems have become popular for conducting sales demonstrations, business meetings, and classroom instruction. In a common mode of operation, multimedia projection display systems receive analog video signals from a personal computer ("PC"). The video signals represent still, partial-, or full-motion, display images of the type rendered by the PC. The analog video signals are converted into digital video signals to control digitally-driven display devices, such as a transmissive or reflective liquid crystal displays or digital micro-mirror devices (hereafter "light valves"), to form the display images for projection onto a display screen. A wide variety of such display systems are available from In Focus Systems, Inc., the assignee of this application.

A necessary feature of multimedia display systems is compatibility with the various analog video signal modes generated by PCs and other video sources. These modes typically range from 640×480 to 1600×1200 resolutions provided at image refresh rates ranging from 60 Hz to 100 Hz. The resolution expresses the number of controllable horizontal and vertical pixel elements that can be turned on and off. Given the variety of display modes, multimedia display systems include an interface that converts analog video signals of various modes to digital video signals capable of controlling the light valves.

Analog video signals typically include image information for each of the red, green and blue colors, and timing signals, which may include a horizontal synchronizing pulse ("$H_{SYNC}$") and a vertical synchronizing pulse ("$V_{SYNC}$"), or a composite image and sync signal. The color image information is stored in the PC memory as digital color data and is converted to the analog video signals by digital-to-analog converters. When composite sync is employed, a conventional sync separator is used to extract the $H_{SYNC}$ and $V_{SYNC}$ timing pulses.

The timing signals synchronize the scanning of the analog video signals across a raster-scanned display device. The $H_{SYNC}$ pulse controls the horizontal scanning timing, and the $V_{SYNC}$ pulse controls the vertical scanning or video frame refresh timing.

FIG. 1 shows that each video frame 1 typically includes a central active video region 2 surrounded by an inactive or blanked margin 3. The resolution of a raster-scanned display refers to the number of displayable image information points ("pixels") in active video region 2.

Because the light valves employed by multimedia display systems require digital video signals, either the light valve or the display system normally includes an analog-to-digital converter ("ADC") for converting the PC-generated analog video signals into a digital format suitable for driving the light valve. The ADC is typically digitizes samples of the analog video signal under control of a voltage-controlled oscillator ("VCO"), which is in turn controlled by a phase-locked loop ("PLL") that locks to a predetermined multiple "n" of the $H_{SYNC}$ pulses.

FIG. 2 shows an exemplary analog signal waveform 4, with plateau regions (pixel data components) 5 that correspond to the color levels of individual pixels in the image display. Consecutive pixel data components 5 are connected by signal transition regions 6.

FIG. 2 further shows a typical pixel clock waveform 7, which is generated by the VCO. The number n of pixel clock pulses 8 per $H_{SYNC}$ pulse is typically set to match the resolution mode established by the PC or other analog video source. To determine the resolution mode, certain characteristics of the analog video signal, such as the number of $H_{SYNC}$ pulses per $V_{SYNC}$ pulse, may be used to refer to a mode lookup table. The resulting number n is set to equal the number of pixel data components in each horizontal line of the analog video signal, including those in active video data region 2 and blanked margin regions 3 (FIG. 1). For example, for a 640×480 screen resolution, n may be set to about 800 to include pixels in blanked regions 3 on either side of the 640 pixel-wide active video region 2. Thus, pixel clock pulses 8 would cause the ADC to sample analog signal waveform 4 about 800 times along each horizontal scan line of video frame 1.

FIG. 2 also shows the desired timing relationship between analog signal waveform 4 and pixel clock waveform 7. The number n of pixel clock pulses 8 is set to establish a one-to-one relationship between pixel clock pulses 8 and pixel data components 5 of analog signal waveform 4. This one-to-one relationship requires that the pixel clock signal frequency be equal to the analog video signal frequency. Under this relationship, each pixel data component 5 is sampled by a single pixel clock pulse 8, such that the ADC properly digitizes instantaneous voltage value of each pixel data component 5. Because pixel clock pulses 8 have "jitter" zones 9 at their leading and trailing edges, pixel clock pulses 8 should be centered on pixel data components 5, so that the ADC sampling is not randomly shifted by jitter zones 9 into signal transition regions 6 of analog signal waveform 4.

The stream of digitized signal values from the ADC form the digital video data signal that is conveyed to the light valve to activate or deactivate its pixels in a pattern corresponding to the image defined by analog signal waveform 4. Unfortunately, such ADC conversion is often imperfect because of sample timing errors caused by pixel clock pulses 8. Such sample timing errors are typically caused by pixel clock frequency deviations ("tracking" errors) and "phase" errors, both of which may degrade the quality of images generated by the light valve or valves.

FIG. 3 shows a typical tracking error resulting from improperly setting the number n of pixel clocks along the entirety of pixel clock waveform 7'. As described above, the number n of pixel clock pulses 8' should be equal to the number of pixel data components 5 of each horizontal line of analog signal waveform 4. The improper setting of n results in pixel data components 5 being sampled at inconsistent points. For example, n is set too large in pixel clock waveform 7' (i.e. the frequency is too high). The resultant crowding of the pixel clock pulses 8' causes an additive leftward drift of pixel clock pulses 8' relative to pixel data components 5. Such drift causes sampling in signal transition regions 6 as shown by positional bracket A in which leading edges 9' of the third through sixth of pixel clock pulses 8' sample in transition regions 6 of analog signal waveform 4. Accordingly, the transition region data will be erroneous and the image information from adjacent non-sampled pixel data components 5 will be missing from the digitized video signal. If n is erroneously set large enough, pixel clock pulses 8' may be so crowded that individual analog pixel data components 5 may be double-sampled. On the other hand, if n is set too small (i.e. the frequency is too low), the resulting dispersion of pixel clock pulses 8' results in a rightward drift in which sampling may also occur in signal transition regions 6.

To minimize tracking and phase errors, prior workers have provided some multimedia projection systems with manual controls that permit an operator to adjust the number n and the phase of pixel clocks pulses 8. The controls are adjusted until the projected image appears satisfactory to the eye of the operator. While manual controls are usually effective in achieving an acceptable image quality, adjusting such manual controls is time-consuming and inhibits the user-friendliness of the multimedia projection system.

Accordingly, other prior workers have developed automated pixel clock adjusting techniques. For example, U.S. Pat. No. 5,657,089 for VIDEO SIGNAL PROCESSING DEVICE FOR SAMPLING TV SIGNALS TO PRODUCE DIGITAL DATA WITH INTERVAL CONTROL describes an active video interval detector that generates data indicative of a difference between the detected active video interval and a required reference video interval. A video signal supply interval controller receives the difference data and provides frequency-dividing ratio control data to a programmable frequency divider that is part of the PLL controlling the pixel clock frequency. Over a number of video frames, the difference data is iterated toward zero to achieve accurate pixel clock tracking. Unfortunately, some PCs generate video signals with an indefinite "black" video level, which makes the active video interval difficult to determine. Moreover, the iterative nature of this technique often requires an unduly long time to achieve accurate pixel clock tracking.

Another example of automated pixel clock adjusting techniques is described in U.S. Pat. No. 5,805,233 for METHOD AND APPARATUS FOR AUTOMATIC PIXEL CLOCK PHASE AND FREQUENCY CORRECTION IN ANALOG TO DIGITAL VIDEO SIGNAL CONVERSION, which is assigned to the assignee of this application and incorporated herein by reference. This patent describes employing a mode lookup table to determine an expected number n of pixel clock pulses per scan line and comparing the actual number n with the expected number to generate a tracking error approximation. The number n is adjusted each vertical cycle to iterate toward an acceptable pixel clock frequency. This technique typically requires 16 to 60 video frames to adjust the pixel clock frequency, and there is no certainty that the resulting frequency will result in accurate tracking.

What is needed, therefore, is a fast and accurate technique for generating a pixel clock that is free of tracking errors.

SUMMARY OF THE INVENTION

An object of this invention is, therefore, to provide an apparatus and a method for generating an accurate pixel sampling clock for digitizing an analog video signal at optimal pixel locations along the analog video signal.

Another object of this invention is to generate the pixel sampling clock in one vertical period of the analog video signal.

A further object of this invention is to eliminate the need for a prior art mode table that stores approximate starting points for estimating the pixel sampling clock frequency.

A line parameter detection circuit of this invention includes an active video detector that generates an "active video" signal indicative of a video signal containing video data that exceeds a predetermined threshold level. The line parameter detection circuit further includes three counters that are incremented by a reference clock. The counters are reset and start counting reference clock pulses upon receiving an $H_{SYNC}$ pulse. A left edge register stores the count accumulated in the first counter upon receiving a rising edge of the active video signal, a right edge register stores the count accumulated in the second counter upon receiving a falling edge of the active video signal, and a line length register stores the count accumulated in the third counter upon receiving the next subsequent $H_{SYNC}$ pulse.

Each video signal scan line includes blanking periods between the $H_{SYNC}$ pulses and the active video region. The precise locations and timings of the blanking periods are typically unknown, however the period of the active video region is known because it coincides with the active video signal generated by the active video detector. The timing ratio of the active video region to the blanking periods is determined from the line parameter detection circuit, from which the ratio of total blanking time to total line time is determined. The ratio of total blanking time to total line time is used to calculate the overall tracking period, and from that a tracking number n and pixel clock pulse frequency can be determined.

In particular, a left edge count is stored in the left edge register at the first point in time that the active video signal is asserted. The left edge count is sensed by a microcontroller for each video data scan line in a video frame, and only the smallest of the left edge counts is saved for processing by the microcontroller.

Likewise, a right edge count is stored in the right edge register at the last point in time that the active video signal is asserted. The right edge count is sensed by the microcontroller for each video data scan line in the video frame, and only the largest of the right edge counts is saved for processing by the microcontroller.

A total line count is stored in the line length register and is periodically sensed by the microcontroller for processing.

The microcontroller computes an active clock count by subtracting the left edge count from the right edge count.

Then the microcontroller computes an active region percentage by dividing the active clock count by the total line count.

The microcontroller next computes a tracking number n by dividing a deduced horizontal resolution by the active region percentage. The deduced horizontal resolution, if unknown, is determined by counting the number of $H_{SYNC}$ pulses in the video frame to determine a vertical resolution count and then finding the deduced horizontal resolution from a standard display resolution table.

The microcontroller may optionally compute a pixel frequency by multiplying the reference clock frequency by the tracking number n and dividing the result by the total line count.

This invention allows the tracking number n to be determined without a mode table and within one frame period, whereas prior methods had taken 16 to 60 frame periods to converge on the proper tracking number n.

Additional objects and advantages of this invention will be apparent from the following detailed description of a preferred embodiment thereof that proceeds with reference to the accompanying drawings.

DETAILED DESCRIPTION OF A PREFERRED EMBODIMENT

Figure 4:
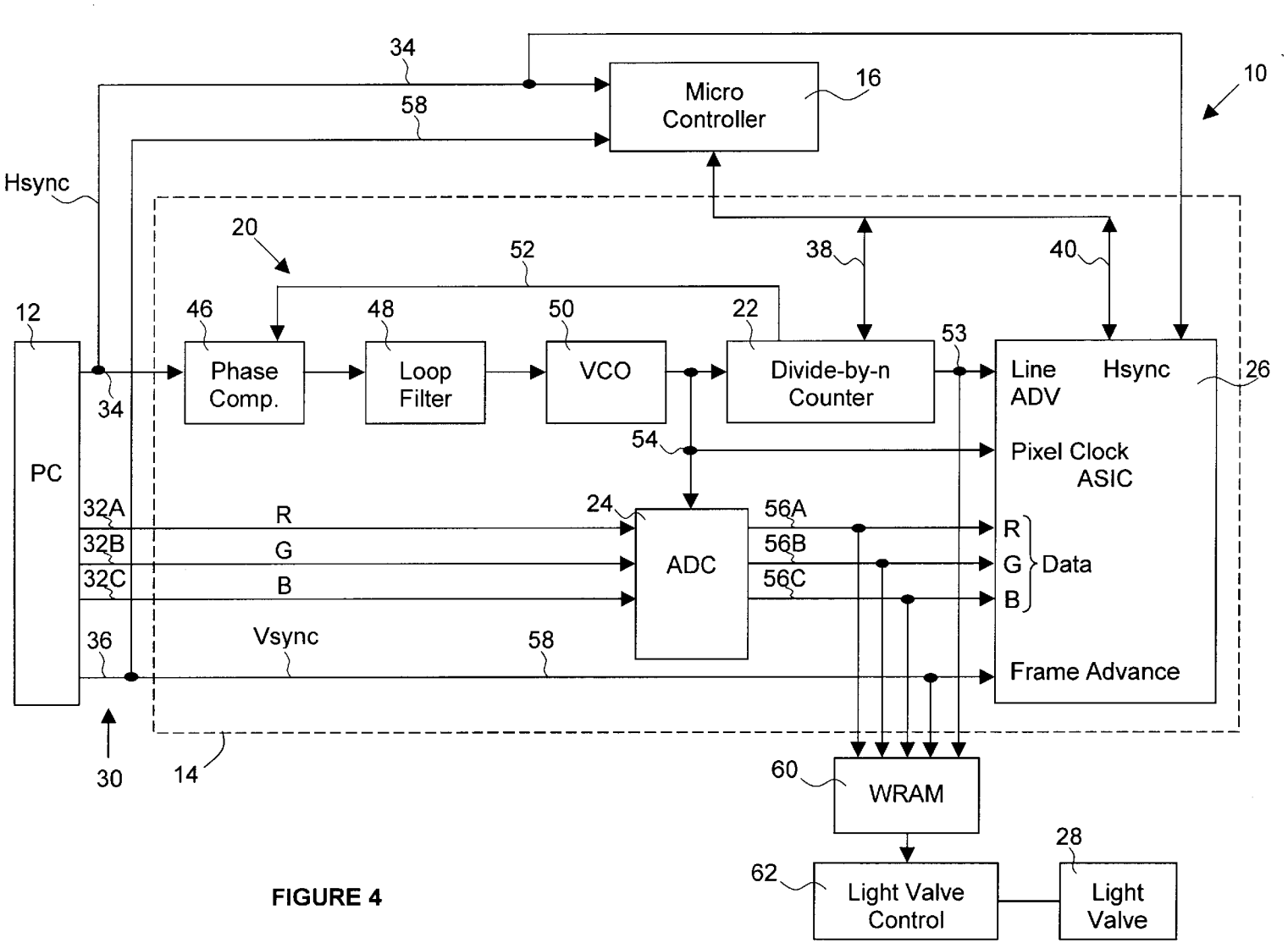
FIG. 4 is an overall simplified schematic block diagram representing a multimedia projection display system suitable for use with this invention and showing an analog video signal digitizing circuit that coacts with a pixel clock tracking method of this invention.

FIG. 4 shows a representative projection display system 10 suitable for use with this invention that is connected to an analog video signal source 12, such as a PC. Projection display system 10 includes an image capture circuit 14 and a microcontroller 16 that cooperate to automatically eliminate tracking errors. Image capture circuit 14 includes a PLL 20, a divide-by-n-counter 22, an ADC 24, and an Application Specific Integrated Circuit ("ASIC") 26 that contains image edge and line length counters of this invention. Microcontroller 16 executes a firmware program that controls ASIC 26 and counter 22 based on data accumulated in the image edge and line length counters. A light valve 28, is coupled to the output of ADC 24.

Multimedia source 12 is connected to projection display system 10 through a conventional video source cable 30 that includes multiple distinct conductors including: three separate channels 32A, 32B, and 32C for carrying analog signals corresponding to red ("R"), green ("G"), and blue ("B") video components; and two conductors 34 and 36 carrying the respective $H_{SYNC}$ and $V_{SYNC}$ pulses. Microcontroller 16 is connected to counter 22 by a bus 38, and to ASIC 26 by a bus 40. Skilled workers will recognize that multiple types of microcontrollers are suitable for use with this invention.

PLL 20 is of conventional design including a phase comparator 46, a low-pass filter 48, and a VCO 50. A feedback loop 52 originating at counter 22 couples a submultiple of the VCO 50 frequency to phase comparator 46. Counter 22 is connected to ASIC 26 through a line advance conductor 53, and VCO 50 is connected to ASIC 26 and ADC 24 through a pixel clock conductor 54. Counter 22 is typically integrated within ASIC 26 or microcontroller 16.

The three analog video data signal channels 32A, 32B, and 32C are connected to ADC 24, which typically includes three separate conventional ADC converters for digitizing each of the R, G, and B analog video signals. Three color data signal channels 56A, 56B, and 56C connect ADC 24 to ASIC 26. The $V_{SYNC}$ signal from multimedia source 12 is connected to ASIC 26 through a frame advance conductor 58.

Line advance conductor 53, digital video data signal channels 56A, 56B, and 56C, and frame advance conductor 58 are all connected to the address inputs of a window random access memory ("WRAM") 60. The output of WRAM 60 is connected to a light valve control module 62 that drives light valve 28. The digital video signals output from image capture circuit 14 are manipulated by WRAM 60 and light valve control module 62 to appropriately control light valve 28. For example, the digital video signals may be "flipped" as appropriate to accommodate multimedia display system 10 variations, such as front projection, rear projection, interlaced video, and noninterlaced video modes.

Figure 1:
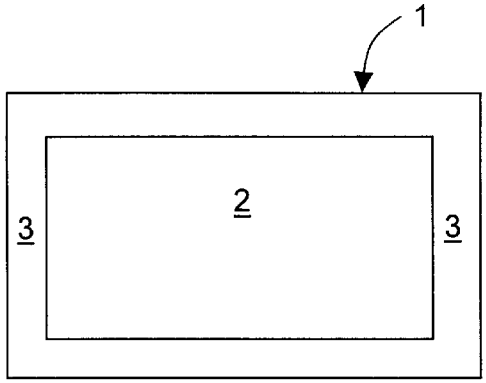
FIGURE 1 (PRIOR ART)
FIG. 1 pictorially represents an exemplary video signal frame, showing a central active video region surrounded by an inactive blanking region.
Figure 2:
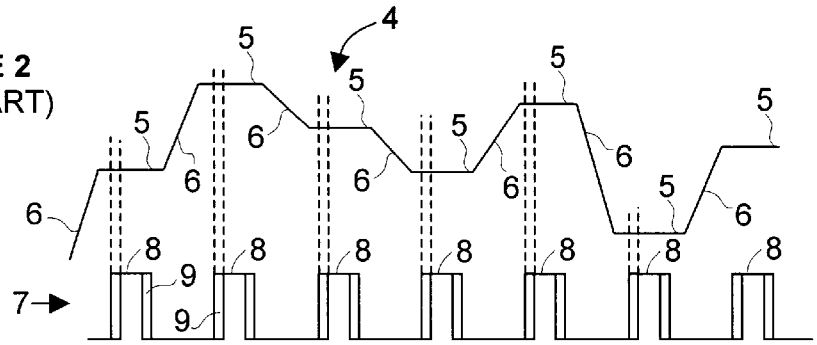
FIGURE 2 (PRIOR ART)
FIG. 2 is an electrical waveform diagram representing an analog video signal waveform and a pixel clock waveform in a desired timing relationship in which no tracking error exists.
Figure 3:
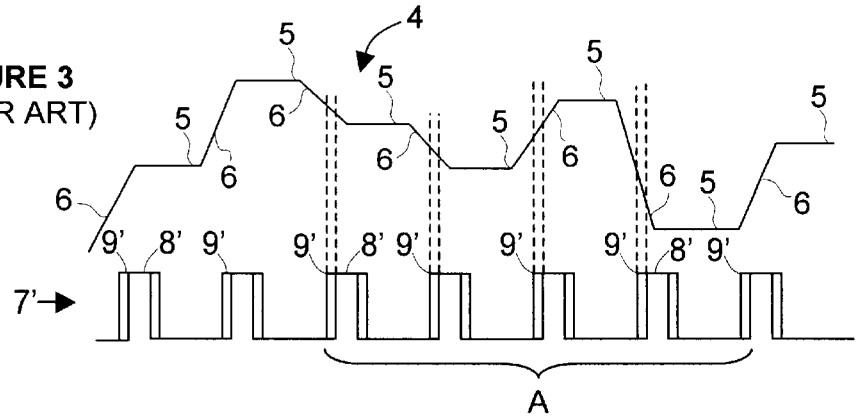
FIGURE 3 (PRIOR ART)
FIG. 3 is an electrical waveform diagram representing an analog video signal waveform and a pixel clock waveform in a undesired timing relationship in which a tracking error exists.
Figure 5:
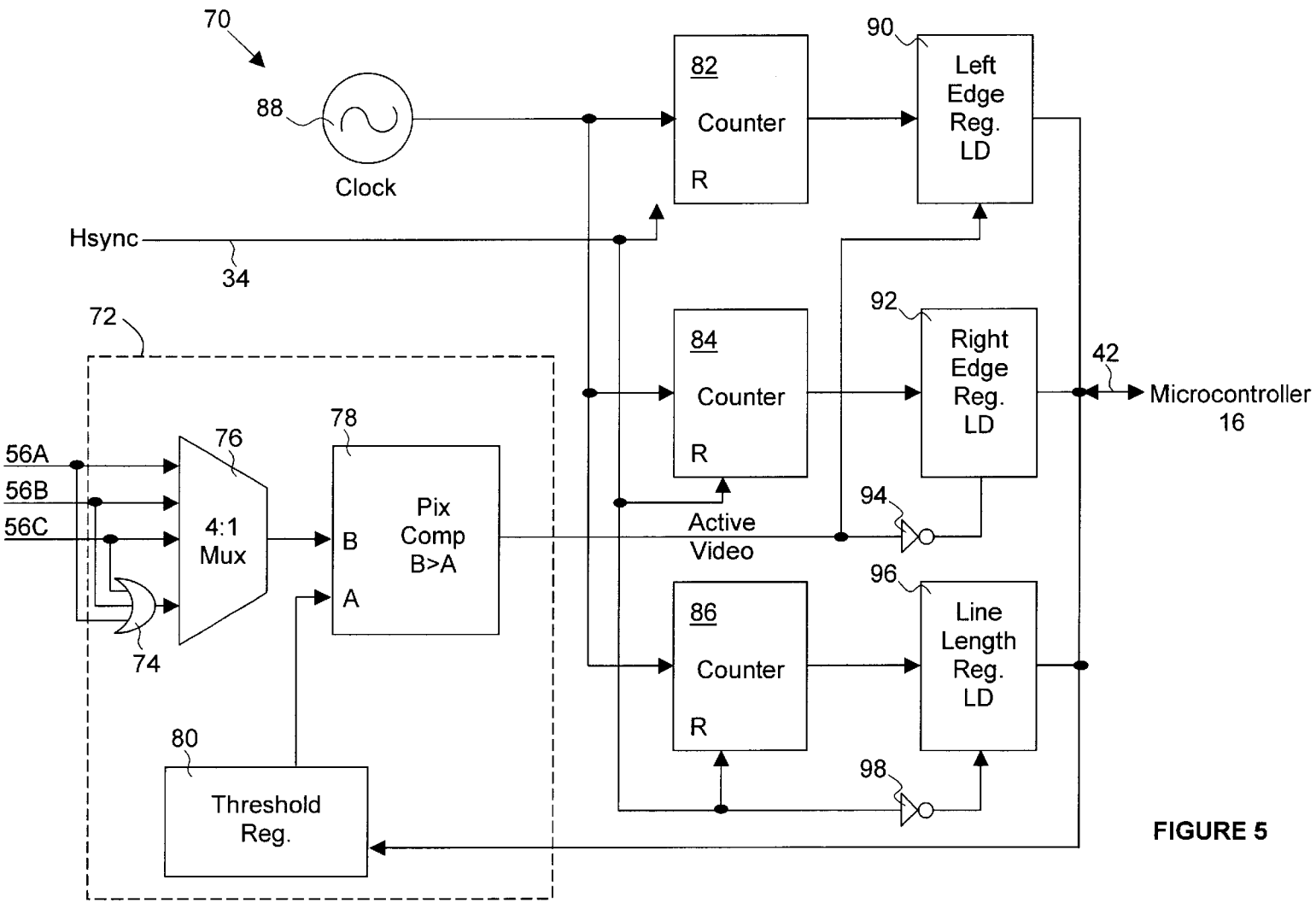
FIG. 5 is an electrical block diagram representing an active video detector and a line parameter detection circuit of this invention.

FIG. 5 shows a line parameter detection circuit 70 that is preferably integrated within ASIC 26, or alternatively, within microcontroller 16 if its clocking speed permits. Line parameter detection circuit 70 includes an active video detector 72 in which RGB video data signal channels 56A, 56B, and 56C are connected to an OR gate 74 and to a 4:1 multiplexer 76. The output of OR gate 74 is also connected to 4:1 multiplexer 76. The output of 4:1 multiplexer 76 is connected to a B-input of a pixel data comparator 78. An A-input of pixel data comparator 78 is connected to a threshold value register 80, which receives across bus 42 threshold values from microcontroller 16. Whenever B is greater than A, pixel value comparator 78 generates an "active video" signal indicative of a scan line in video frame 1 (FIG. 1) traversing active video region 2 (FIG. 1).

Line parameter detection circuit 70 further includes first, second, and third counters 82, 84, and 86, which are all incremented by a reference clock 88 running at a constant frequency preferably ranging between 50 MHZ and 100 MHZ. First, second, and third counters 82, 84, and 86 are reset by the rising edge of the $H_{SYNC}$ pulse on conductor 34 and start up-counting at the falling edge of the $H_{SYNC}$ pulse.

The count output of first counter 82 is connected to a left edge register 90 that stores the accumulated count in first counter 82 upon receiving the rising edge of the active video signal. The count stored in left edge register 90 is proportional to the time interval between the falling edge of the $H_{SYNC}$ pulse and the rising (left) edge of the active video signal and is accessible to microcontroller 16 on bus 42.

The count output of second counter 84 is connected to a right edge register 92 that stores the accumulated count in second counter 84 upon receiving from an inverter 94 a signal indicative of the falling edge of the active video signal. The count stored in right edge register 92 is proportional to the time interval between the falling (right) edge of the $H_{SYNC}$ pulse and the falling edge of the active video signal and is accessible to microcontroller 16 on bus 42.

The count output of third counter 86 is connected to a line length register 96 that stores the accumulated count in third counter 86 upon receiving from an inverter 98 a signal indicative of the falling edge of the $H_{SYNC}$ pulse. The count stored in line length register 96 is proportional to the time interval between consecutive falling edges of the $H_{SYNC}$ pulse and is accessible to microcontroller 16 on bus 42.

OPERATION

This invention provides an accurate method for generating in a single video frame period a pixel sampling clock that is free of tracking errors. In other words, the pixel sampling clock will have the same frequency as whatever clock originally generated the lines of analog data being sampled.

Figure 6:
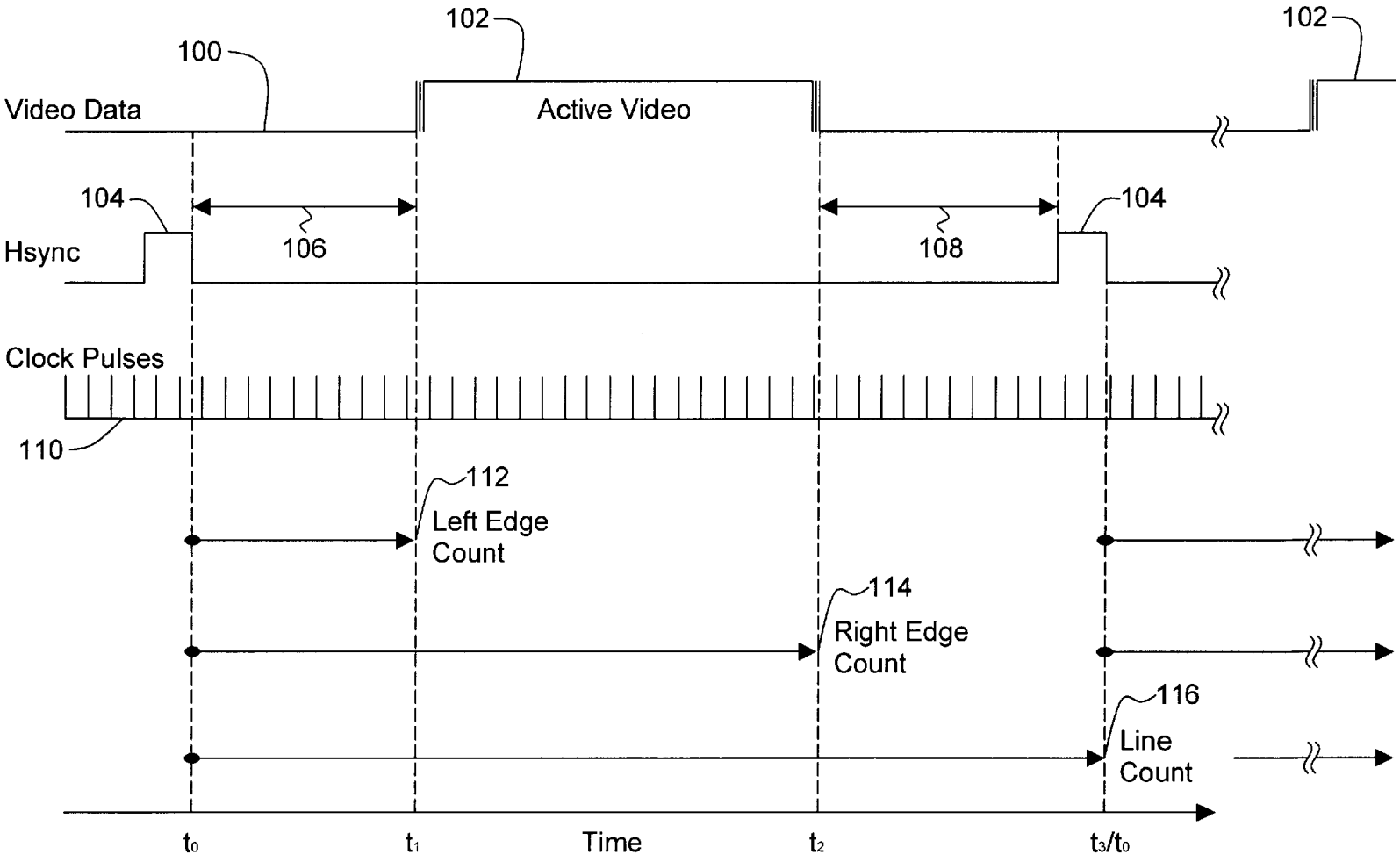
FIG. 6 is a timing diagram representing counters accumulating scan line timing relationships existing among video data, horizontal sync pulses, and a reference clock signal.

FIG. 6 shows a representative video data scan line 100 having an active video region 102. Also shown are $H_{SYNC}$ pulses 104 that initiate the start of each video data scan line 100. A back porch blanking period 106 exists between the falling edges of $H_{SYNC}$ pulses 104 and the rising edges of active video regions 102, and a front porch blanking period 108 exists between the falling edges of active video regions 102 and the rising edges of $H_{SYNC}$ pulses 104. The precise locations and timings of blanking periods 106 and 108 are typically unknown, however the period of active video region 102 is known because it coincides with the active video signal generated by pixel value comparator 78 (FIG. 5).

The timing ratio of active video region 102 to blanking periods 106 and 108 is determined by line parameter detection circuit 70, from which the ratio of total blanking time to total line time is determined. The ratio of total blanking time to total line time is used to calculate the overall tracking period, and from that a tracking number n and pixel clock pulse frequency can be determined.

Referring to FIGS. 5 and 6, line parameter detection circuit 70 counts the number of reference clock 88 pulses 110 accumulated during three time periods starting from a starting time $T_0$ and ending at a left edge time $T_1$, a right edge time $T_2$, and a total line time $T_3$. As described above, the numbers of clock pulses 110 accumulated during the corresponding time periods are stored respectively in left edge register 90, right edge register 92, and line length register 96.

At the start of each video data scan line 100, one of $H_{sync}$ pulses 104 resets first, second, and third counters 82, 84 and 86 and they begin accumulating the number of block pulses 110.

A left edge clock pulse count (hereinafter simply, "left edge count") 112 is stored in left edge register 90 at the first point in time that active video detector 72 detects that each video data scan line 100 is at or above the threshold level. Left edge count 112 is sensed by microcontroller 16 for each video data scan line 100 in a video frame, and only the smallest of left edge counts 112 is saved for processing.

A right edge clock pulse count (hereinafter simply, "right edge count") 114 is stored in right edge register 92 at the last point in time that active video detector 72 detects that each video data scan line 100 is at or above the threshold level. Right edge count 114 is sense by microcontroller 16 for each video data scan line 100 in a video frame, and only the largest of right edge counts 112 is saved for processing.

A total line clock pulse count (hereinafter simply, "total line cont") 116 is stored in line length register 96 at the falling edge of each of Hsync pulses 104. Total line count 116 is substantially constant during the video frame is periodically sense by microcontroller 16 for processing.

The tracking number n and the pixel clock frequency are calculated by microcontroller 16 as described below by employing the stored values of left edge count 112, right edge count 114, and total line count 116 that are captured during one video frame.

Microcontroller 16 computes an active clock count by subtracting left edge count 112 from right edge count 114 as represented in Equation 1.

$$\text{Active Clock Count} = \text{Right Edge Count} - \text{Left Edge Count} \quad (1)$$

Microcontroller 16 computes an active region percentage by dividing action clock count by total line count 116 as represented in Equation 2.

$$\text{Active Region Percentage} = \text{Active Clock Count}/\text{Total Line Count} \quad (2)$$

Microcontroller 16 computes tracking number n by dividing a deduced horizontal resolution by active region percentage as represented in Equation 3.

$$n = \text{Deduced Horizontal Resolution}/\text{Active Region Percentage}$$

Deduced horizontal resolution, if unknown, is determined by microcontroller 16 counting the number of $H_{sync}$ pulses 104 in the video frame to determine a vertical resolution count and then finding deduced horizontal resolution from a standard display resolution table, such as one represented below in Table 1. Vertical resolution count will be higher than the actual vertical resolution because of a vertical blanking period required to accommodate scanning retrace periods required by raster scanned monitors. However, vertical resolution count will be less than the next higher actual vertical resolution in the standard display resolution table.

For example, a 800×600 display resolution will contain greater than 600 lines per frame but generally less than 768 lines per frame. If vertical resolution count is 628 lines, the standard resolution is 800×600 and deduced horizontal resolution is 800. (The horizontal resolution is typically the larger of the two resolution numbers.)

TABLE 1

| Typical Lines/Frame | Standard Resolution | Typical Pixel Clocks/Line (n) |
|---|---|---|
| 525 | 640 × 480 | 800 |
| 628 | 800 × 600 | 1056 |
| 806 | 1024 × 768 | 1344 |
| 1066 | 1280 × 1024 | 1696 |

Table 1 shows the typical lines per frame and typical pixel clock per line merely for reference purposes. In practice, only the standard resolution entries are required, and only if the resolution being employed by multimedia source 12 (FIG. 4) is unknown.

Microcontroller 16 may optionally compute a pixel frequency 126 by multiplying the frequency of reference clock pulses 110 by tracking number n and dividing the result by total line count 116 as represented in Equation 4.

$$\text{Pixel Frequency} = (n^* \text{Reference Clock Frequency})/\text{Total Line Count} \quad (4)$$

For example, assume that the number of lines per frame is 628 (display resolution is 800×609), reference clock 88 is running at 50 MHZ, the minimum left edge count 112 in a frame is 100, the maximum right edge count 114 in the frame is 1,024, and the total line count 116 is 1,220. Then employing:

equation 1, the active clock count=1,024−100=924;

equation 2, the active region percentage=924/1,220=0.7576;

equation 3, n=800/0.7576=1,056; and equation 4, the pixel frequency=(1,056*50)/1,220=43.27 MHZ.

Referring to FIG. 4, digitization of the analog video data signals occurs based on n equaling 1,056 pixel clocks per line. In PLL 20, VCO 50 generates the pixel clock signal, and microcontroller 16 sets counter 22 to generate a feedback pulse (i.e. line advance signal) once every 1,056 pixel clocks. PLL 20 automatically adjusts to produce a line advance signal frequency corresponding to $H_{SYNC}$ pulse frequency, and a pixel clock signal having a frequency of 43.27 MHZ.

PLL 20 operates by phase comparator 46 receiving the $H_{SYNC}$ pulses over conductor 34 and receiving the feedback pulse signal through the feedback loop 52. Phase comparator 46 compares the $H_{SYNC}$ pulses and feedback pulse signals and generates an output voltage that is a measure of their phase difference. If the feedback pulse frequency does not equal the $H_{SYNC}$ pulse frequency, the phase difference signal causes the pixel clock frequency generated by VCO 50 to deviate such that the feedback pulse frequency from counter 22 deviates toward the $H_{SYNC}$ pulse frequency.

ADC 24 samples the instantaneous voltage values of the analog video data signal at the leading edge of each of the pixel clocks, thereby generating a series of sampled data signal values.

Skilled workers will recognize that portions of this invention may be implemented differently from the implementations described above for a preferred embodiments. For example, various subsystems of this invention may have analog and/or digital implementations, such as active region detector 72, phase-locked loop 20, and line parameter circuit 70. Reference clock 88 may operate at a wide range of fixed frequencies, provided they are significantly higher than the pixel frequency. Line parameter circuit 70 may be implemented in ASIC 26, as a program executed in microcontroller 16, or as discrete components. The counters may be substituted by timers, and the edge and line length registers are not necessarily required if microcontroller 16 can capture and store the count values at the correct times. PLL 20 is not limited to an analog implementation, but may include a digitally synthesized loop.

This invention may also be used to properly horizontally position the active video region on light valve 28. In this application, left edge count 112 can be used to determine when active video data starts being received by WRAM 60, thereby preventing data storage and display of spurious data in the inactive margin region of the video frame.

It should be obvious to skilled workers that many changes may be made to the details of the above-described embodiments of this invention without departing from the underlying principles thereof. Accordingly, it will be appreciated that this invention is also applicable to data acquisition applications other than those found in video multimedia projectors. The scope of this invention should, therefore, be determined only by the following claims.

I claim:

1. In a video data acquisition system in which an analog-to-digital converter employs sampling clock pulses to sample and digitize pixels in a video signal frame including a number Y of video scan lines each initiated by a horizontal sync pulse, each video scan line including an unknown number n of total pixels and a number X of viewable pixels in an active video region bounded by blanking regions, an improved method of determining the number n of total pixels in a video scan line, comprising:

determining an active video region time period;

determining a video scan line time period;

computing a proportion of the active video region time period to the video scan line time period;

computing the number n of total pixels by dividing the number X of viewable pixels by the proportion;

setting a number of sampling clock pulses per video scan line to equal the number n of total pixels in a video scan line; and carrying out the improved method during a signal frame period.

2. The method of claim 1 in which the number X of viewable pixels is also unknown and the method further comprises:

providing a standard resolution table from which standard resolution values of the number X of viewable pixels can be determined from ranges of the number Y of video scan lines;

determining the number Y of video scan lines in the video signal frame; and employing the number Y to lookup the number X in the standard resolution table.

3. The method of claim 1 in which determining the active video region time period further comprises:

determining a minimum time period existing between the horizontal sync pulse and a start of the active video region time period for each of multiple video scan lines;

determining a maximum time period existing between the horizontal sync pulse and an end of the active video region time period for each of multiple video scan lines; and subtracting the minimum time period from the maximum time period to determine the active video region time period.

4. The method of claim 1 in which the sampling clock pulses recur at an unknown sampling clock frequency and the method further comprises providing a reference clock oscillating at a predetermined reference frequency, and computing the sampling clock frequency by multiplying the predetermined reference frequency by the number n of total pixels in a video scan line and dividing the result by a number of oscillations of the predetermined reference frequency occurring between successive horizontal sync pulses.

5. The method of claim 1 in which a reference clock oscillates at a predetermined reference frequency and the determining steps further comprise:

generating an active video signal indicative of a scan line in the video signal frame traversing the active video region;

counting a first number of oscillations of the reference frequency occurring between a horizontal sync pulse and a start of the active video signal;

counting a second number of oscillations of the reference frequency occurring between a horizontal sync pulse and an end of the active video signal; and counting a third number of oscillations of the reference frequency occurring between successive horizontal sync pulses.

6. The method of claim 5 in which determining the active video region time period includes subtracting the first number of oscillations from the second number of oscillations.

7. The method of claim 5 in which computing the proportion includes subtracting the first number of oscillations from the second number of oscillations and dividing the result by the third number of oscillations.

8. The method of claim 1 in which the video data acquisition system is employed in a multimedia projector.

9. In a video data acquisition system in which an analog-to-digital converter employs sampling clock pulses to sample and digitize pixels in a video signal frame including a number Y of video scan lines each initiated by a horizontal sync pulse, each video scan line including an unknown number n of total pixels and a number X of viewable pixels in an active video region bounded by blanking regions, an improved apparatus for determining the number n of total pixels in a video scan line, comprising:

an active video detector generating an active video signal indicative of a scan line in the video signal frame traversing the active video region;

a first timer determining an active video region time period;

a second timer determining a video scan line time period; and a controller computing during a single video signal frame period a proportion of the active video region time period to the video scan line time period, computing the number n of total pixels by dividing the number X of viewable-pixels by the proportion; and setting a number of the sampling clock pulses per video scan line to equal the number n of total pixels in a video scan line.

10. The apparatus of claim 9 in which the number X of viewable pixels is also unknown and the apparatus further includes a counter determining the number Y of video scan lines in the video signal frame, and a standard resolution table storing standard resolution values of the number X of viewable pixels that are determined from ranges of the number Y of video scan lines.

11. The apparatus of claim 9 in which the first timer comprises:

a first counter determining a minimum time count existing between the horizontal sync pulse and a start of the active video signal for each of multiple video scan lines;

a second counter determining a maximum time count existing between the horizontal sync pulse and an end of the active video signal for each of multiple video scan lines; and the controller subtracting the minimum time count from the maximum time count to determine the active video region time period.

12. The apparatus of claim 9 in which the sampling clock pulses recur at an unknown sampling clock frequency and the apparatus further comprises a reference clock oscillating at a predetermined reference frequency, and in which the controller computes the sampling clock frequency by multiplying the predetermined reference frequency by the number n of total pixels in a video scan line and divides the result by a number of oscillations of the predetermined reference frequency occurring between successive horizontal sync pulses.

13. The apparatus of claim 12 in which the predetermined reference frequency is greater than about 50 MHZ.

14. The apparatus of claim 9 further including a reference clock oscillating at a predetermined reference frequency and in which the first and second timers include:

a first counter counting a first number of oscillations of the predetermined reference frequency occurring between a horizontal sync pulse and a start of the active video signal;

a second counter counting a second number of oscillations of the predetermined reference frequency occurring between a horizontal sync pulse and an end of the active video signal; and a third counter counting a third number of oscillations of the predetermined reference frequency occurring between successive horizontal sync pulses.

15. The apparatus of claim 14 in which the controller cooperates with the first timer to determine the active video region time period by subtracting the first number of oscillations from the second number of oscillations.

16. The apparatus of claim 14 in which the controller cooperates with the first and second timers to compute the proportion by subtracting the first number of oscillations from the second number of oscillations and dividing the result by the third number of oscillations.

17. The apparatus of claim 1 in which the video data acquisition system is employed in a multimedia projector.

* * * * *

UNITED STATES PATENT AND TRADEMARK OFFICE

CERTIFICATE OF CORRECTION

PATENT NO. : 6,636,205 B1
DATED : October 21, 2003
INVENTOR(S) : Lasneski

It is certified that error appears in the above-identified patent and that said Letters Patent is hereby corrected as shown below:

Column 7,
Line 36, "...block pulses…" should read -- clock pulses --.
Line 53, "...line cont")…" should read -- line count") --.
Line 54, "...Hsync…" should read -- $H_{sync}$ --.

Column 8,
Line 2, "...action clock…" should read -- active clock --.
Line 53, "...x609),…" should read -- x600), --.

Column 9,
Line 22, "… a preferred embodiments…" should read -- preferred embodiments. --

Signed and Sealed this

Twenty-fifth Day of January, 2005

JON W. DUDAS
*Director of the United States Patent and Trademark Office*